US008733621B2

(12) United States Patent
Anghileri

(10) Patent No.: US 8,733,621 B2
(45) Date of Patent: May 27, 2014

(54) METHOD FOR MANUFACTURING A CONTAINER OF PAPER MATERIAL, PARTICULARLY FOR FOODSTUFFS

(75) Inventor: Gianmario Anghileri, Malgrate (IT)

(73) Assignee: Novacart S.p.A., Garbagnate Monastero (IT)

( * ) Notice: Subject to any disclaimer, the term of this patent is extended or adjusted under 35 U.S.C. 154(b) by 340 days.

(21) Appl. No.: 13/146,893

(22) PCT Filed: Feb. 11, 2010

(86) PCT No.: PCT/IB2010/050624

§ 371 (c)(1),
(2), (4) Date: Nov. 10, 2011

(87) PCT Pub. No.: WO2010/092538

PCT Pub. Date: Aug. 19, 2010

(65) Prior Publication Data

US 2012/0043337 A1 Feb. 23, 2012

(30) Foreign Application Priority Data

Feb. 12, 2009 (IT) ..... MI2009A0181

(51) Int. Cl.
*B65D 75/14* (2006.01)

(52) U.S. Cl.
USPC ..... 229/87.08; 229/87.03; 493/244; 493/310; 493/409; 426/115

(58) Field of Classification Search
USPC ..... 229/87.03, 87.08, 406–407; 150/154, 150/155; 493/104, 108, 152, 153, 154, 155, 493/244, 310, 408, 409, 463; 426/106, 112, 426/115
See application file for complete search history.

(56) References Cited

U.S. PATENT DOCUMENTS

| | | | | | |
|---|---|---|---|---|---|
| 588,690 | A | * | 8/1897 | Brown | 229/90 |
| 1,616,570 | A | * | 2/1927 | Boynton | 426/90 |
| 1,941,944 | A | * | 1/1934 | Kenny | 229/117.12 |
| 2,027,296 | A | * | 1/1936 | Stuart et al. | 206/524.6 |
| 3,054,144 | A | * | 9/1962 | Goodwin et al. | 425/356 |
| 3,481,175 | A | * | 12/1969 | White | 72/333 |

(Continued)

FOREIGN PATENT DOCUMENTS

| | | | |
|---|---|---|---|
| DE | 526 452 | C | 6/1931 |
| DE | 555 677 | C | 7/1932 |

(Continued)

*Primary Examiner* — Gary Elkins
*Assistant Examiner* — Scott McNurlen
(74) *Attorney, Agent, or Firm* — Pearne & Gordon LLp

(57) ABSTRACT

A method of manufacturing containers of paper material for foodstuffs, in particular pastries, wherein the container comprises a single sheet portion of flexible paper material defining a flat bottom wall and a side wall emerging from the bottom wall. The container has a side wall comprising, in section, at least one curvilinear stretch (10) for defining a rounded or convex conformation of the side wall. The method contemplates a first step for making the bottom wall (2) provided with an upper surface (2*a*) and a lower surface (2*b*), and a side wall (3) emerging from the bottom wall (2) in such a manner that in cooperation with said bottom wall it defines a holding region (21) whose bottom consists of said lower surface (2*b*), and a second step of overturning the side wall on the opposite side relative to the bottom wall (2) for defining a cavity (7) having an upwards facing opening in the normal use position of the container.

8 Claims, 21 Drawing Sheets

(56) References Cited

U.S. PATENT DOCUMENTS

Figure 1:
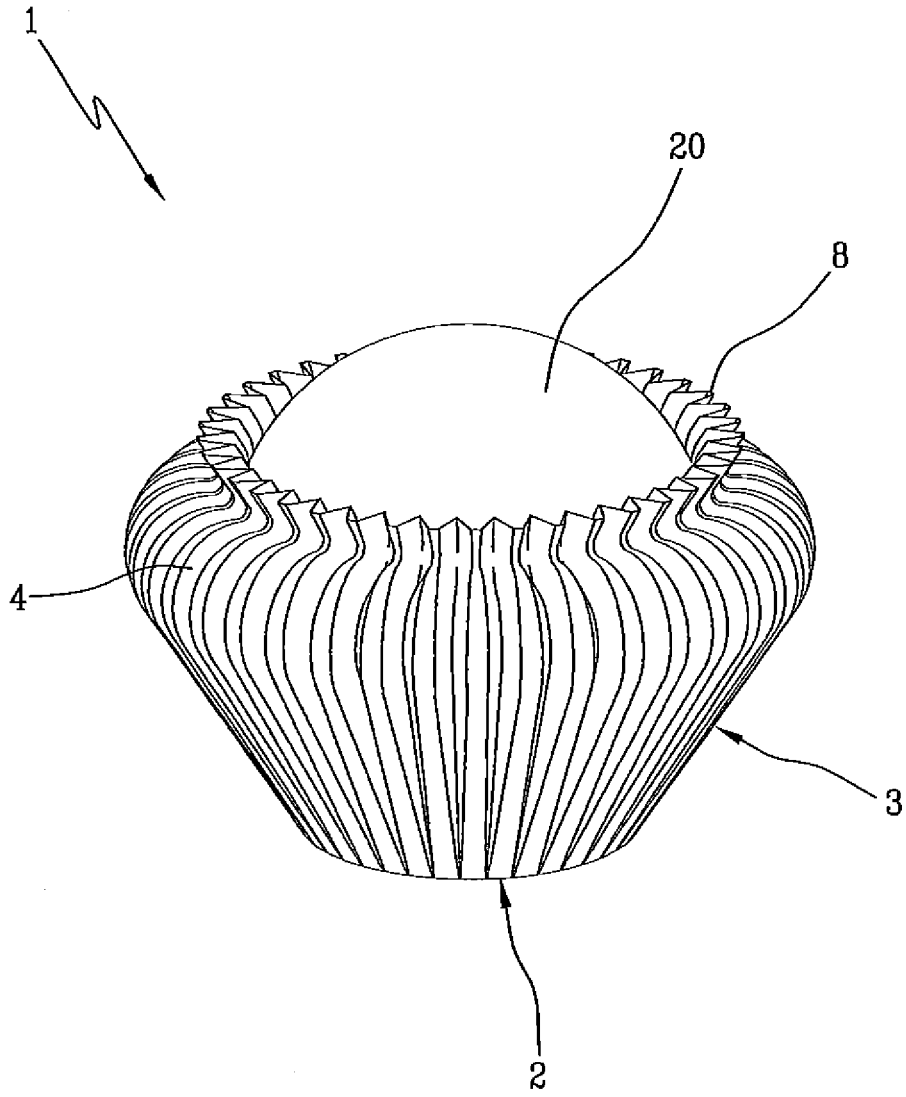

| | | | | | |
|---|---|---|---|---|---|
| 3,512,458 | A | * | 5/1970 | Ehe | 493/114 |
| 3,674,168 | A | * | 7/1972 | Padovani | 217/26.5 |
| 4,235,160 | A | * | 11/1980 | Olney et al. | 493/63 |
| 5,217,631 | A | * | 6/1993 | Anghileri | 249/120 |
| 5,314,398 | A | | 5/1994 | Weder et al. | |
| 6,089,446 | A | | 7/2000 | Hirano | |
| 6,513,306 | B1 | | 2/2003 | Milano | |
| 2005/0093195 | A1 | | 5/2005 | Voges | |
| 2008/0015098 | A1 | * | 1/2008 | Littlejohn et al. | 493/152 |

FOREIGN PATENT DOCUMENTS

| | | | |
|---|---|---|---|
| DE | 730 766 | C | 1/1943 |
| EP | 0 749 895 | A1 | 12/1996 |
| EP | 0800997 | | 10/1997 |
| EP | 1 046 579 | A1 | 10/2000 |
| EP | 1 253 090 | A1 | 10/2002 |
| FR | 2 767 513 | A1 | 2/1999 |
| GB | 128 187 | A | 12/1919 |
| RU | 2136557 | | 9/1999 |

* cited by examiner

FIG 1a
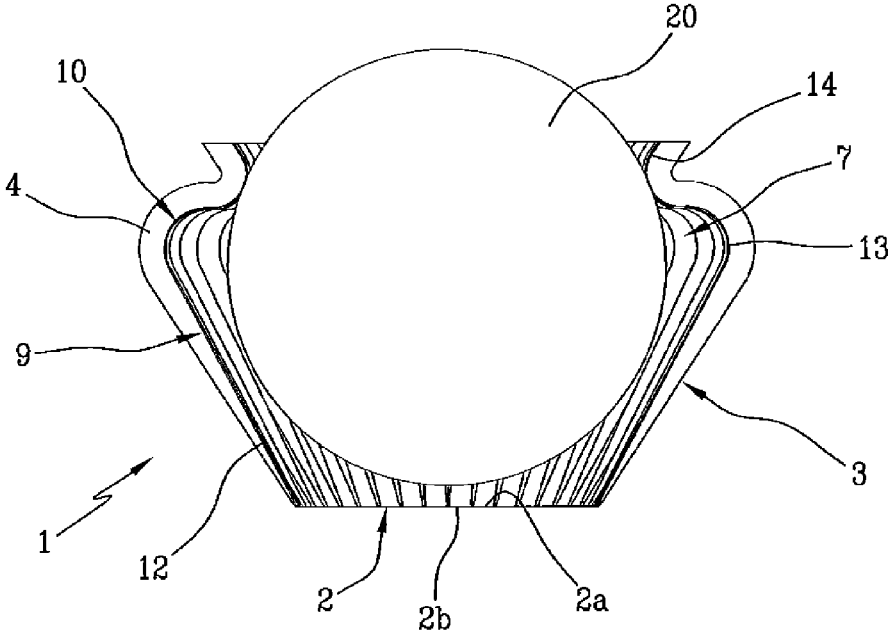
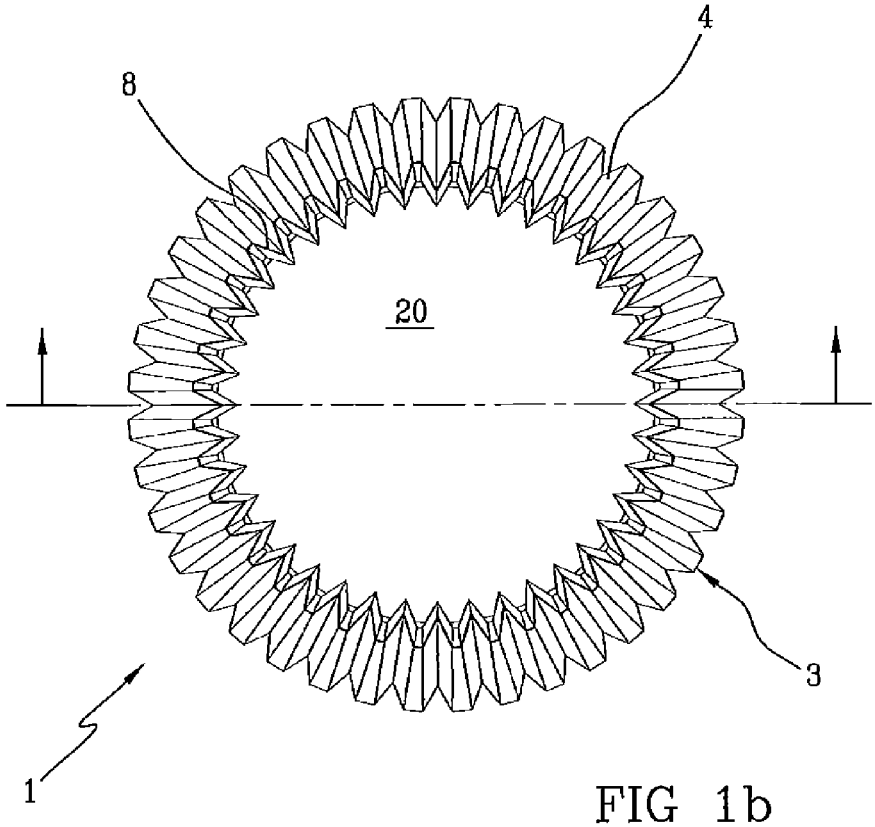
FIG 1b

FIG 2a
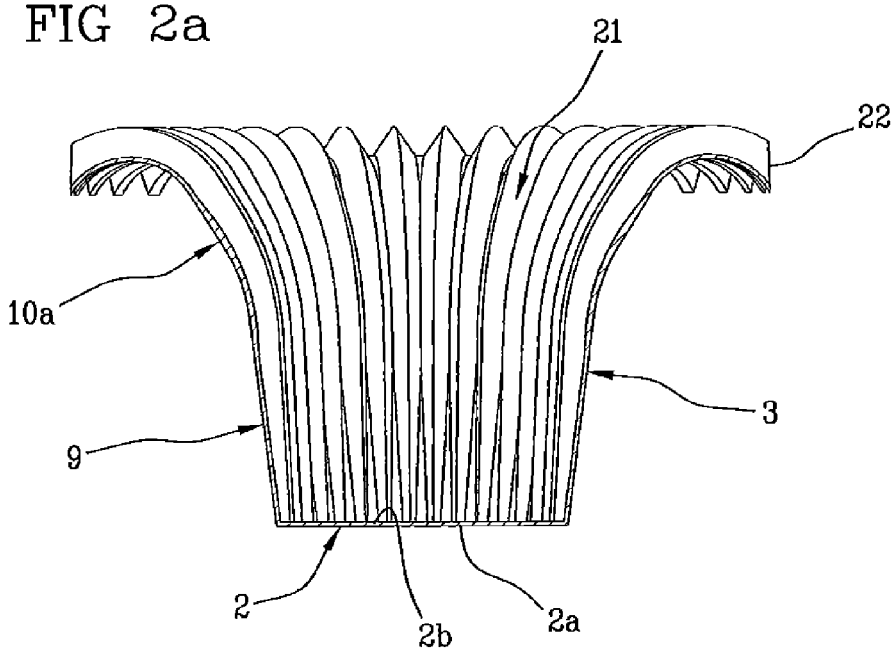
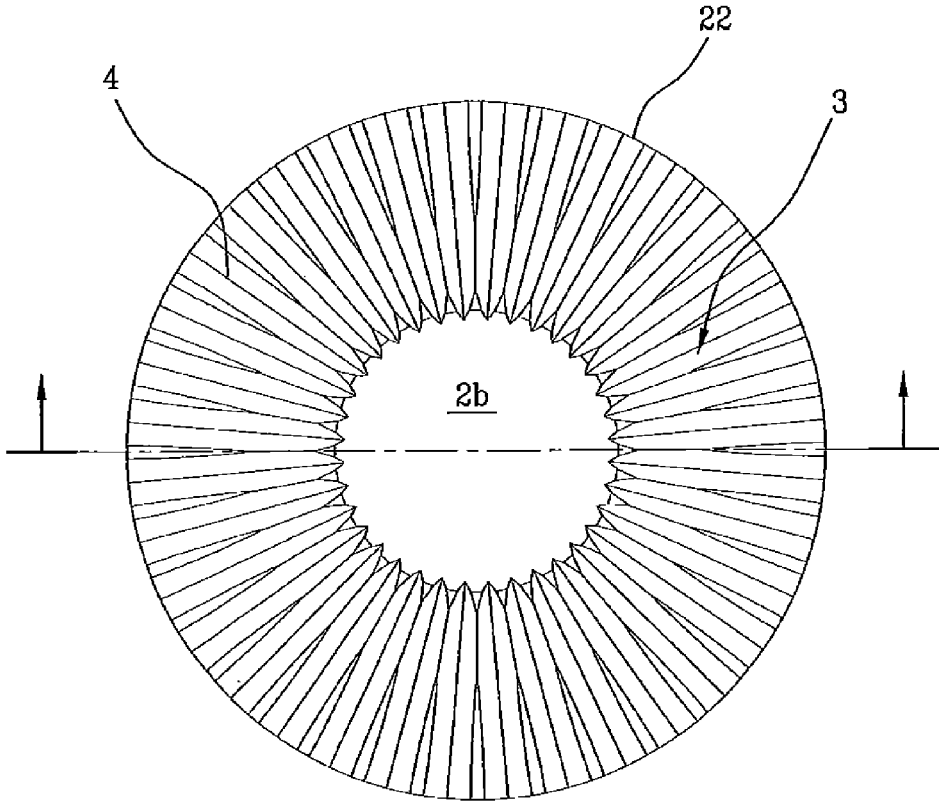
FIG 2b

FIG 3a
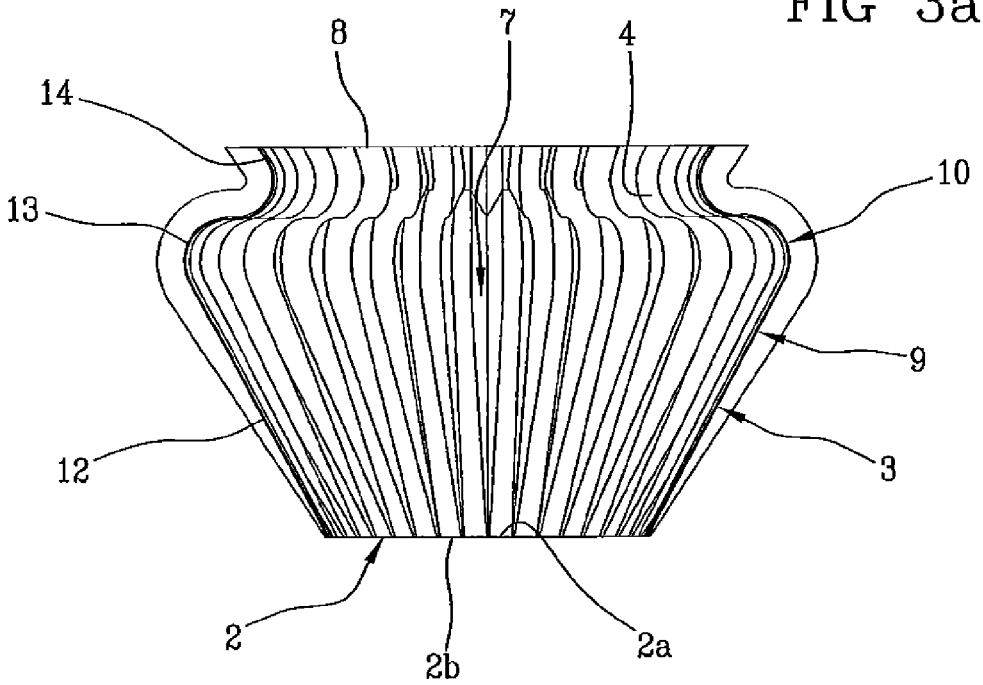
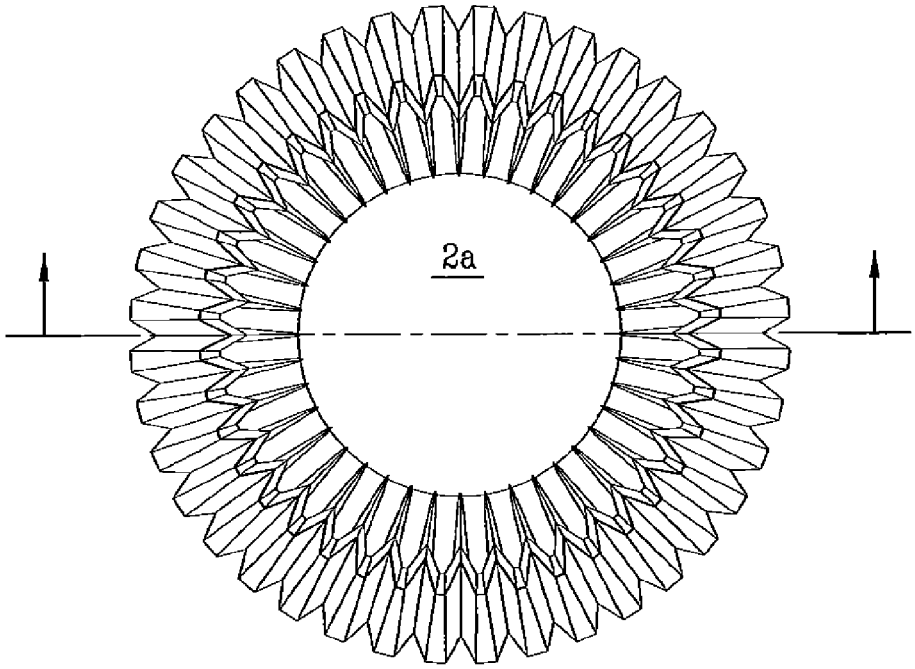
FIG 3b

FIG 5a
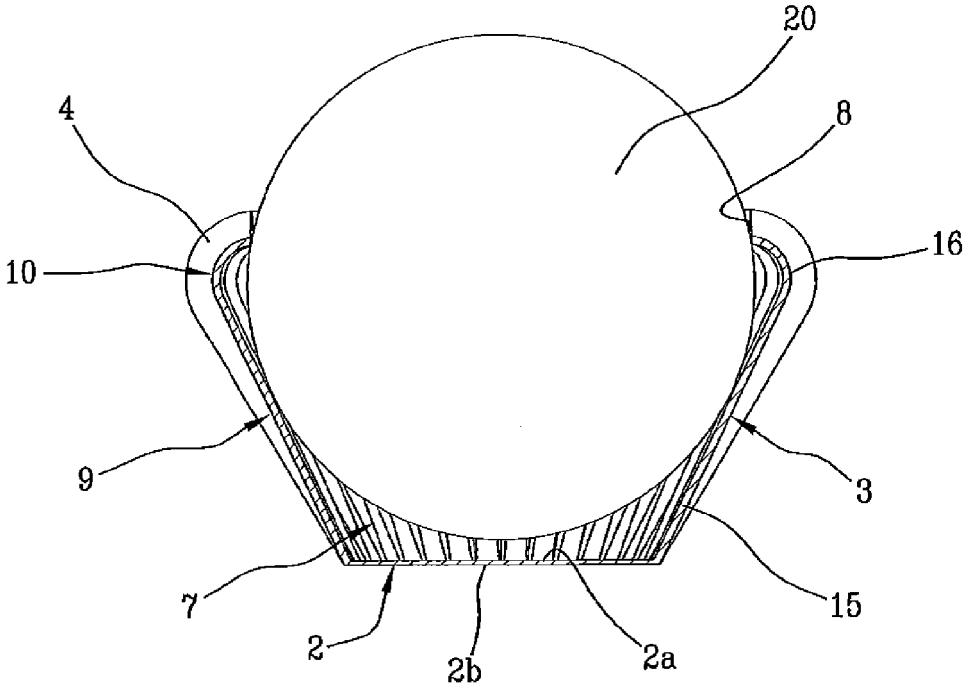
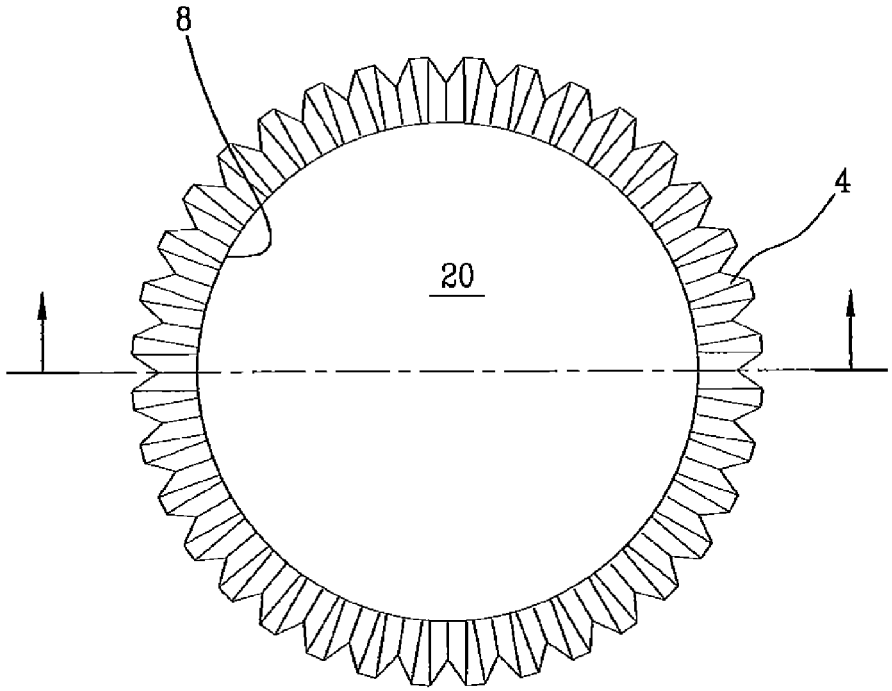
FIG 5b

FIG 6a
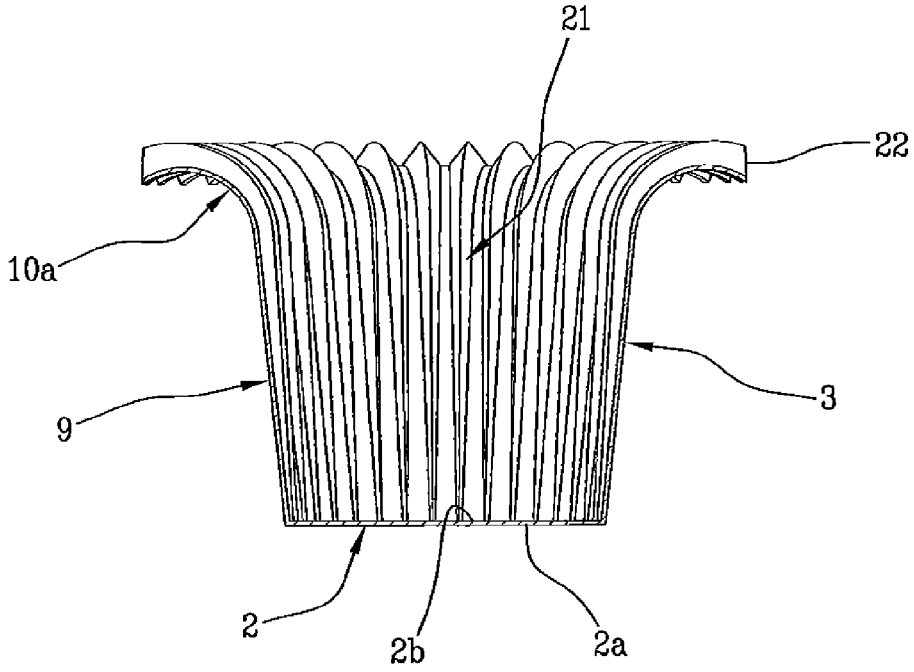
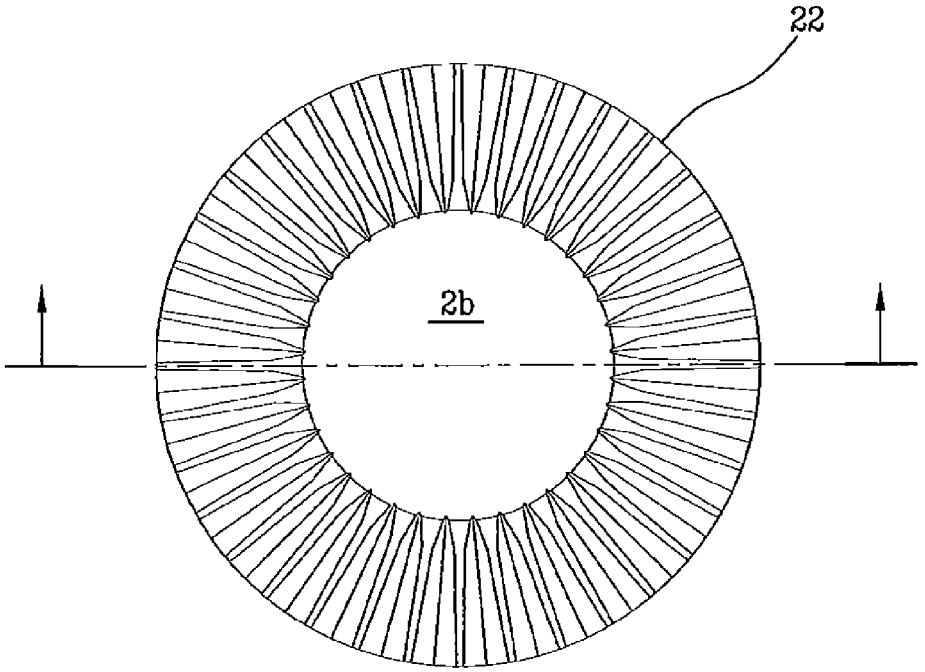
FIG 6b

FIG 7a
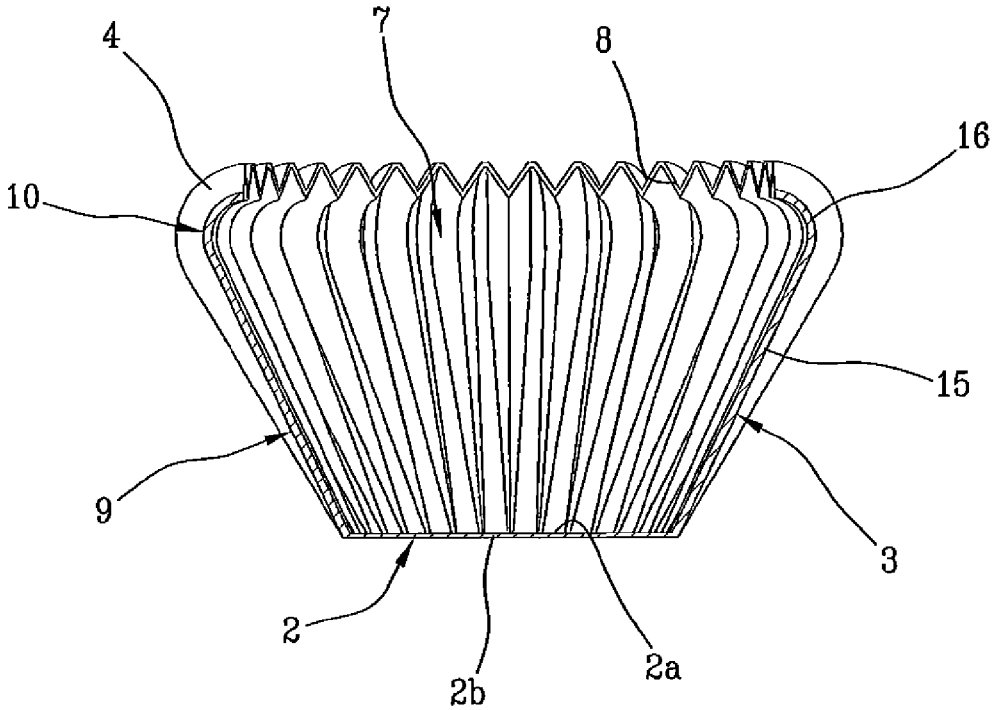
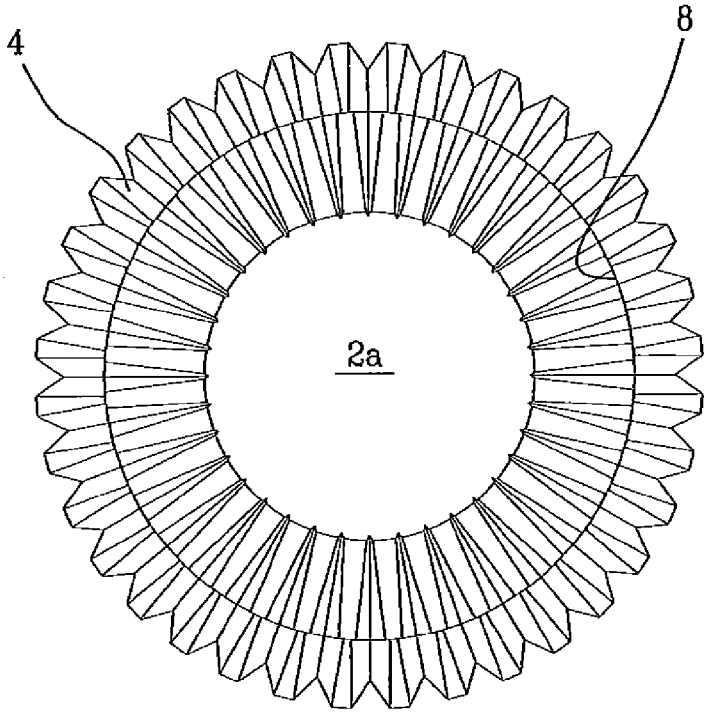
FIG 7b

FIG 8a
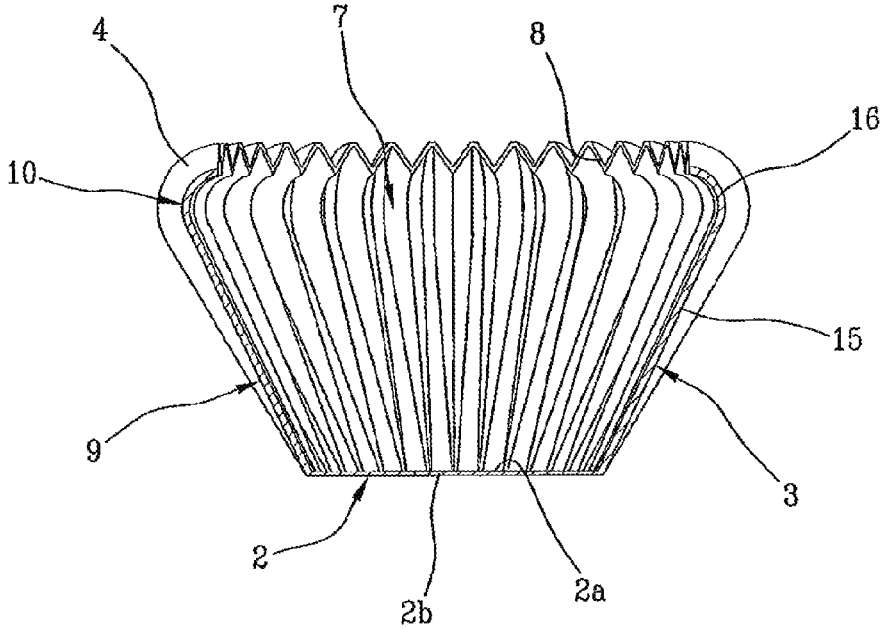
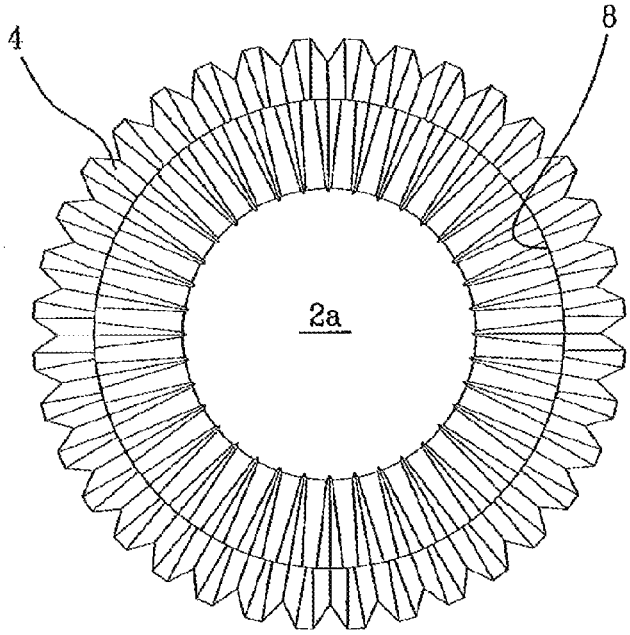
FIG 8b

FIG 9a
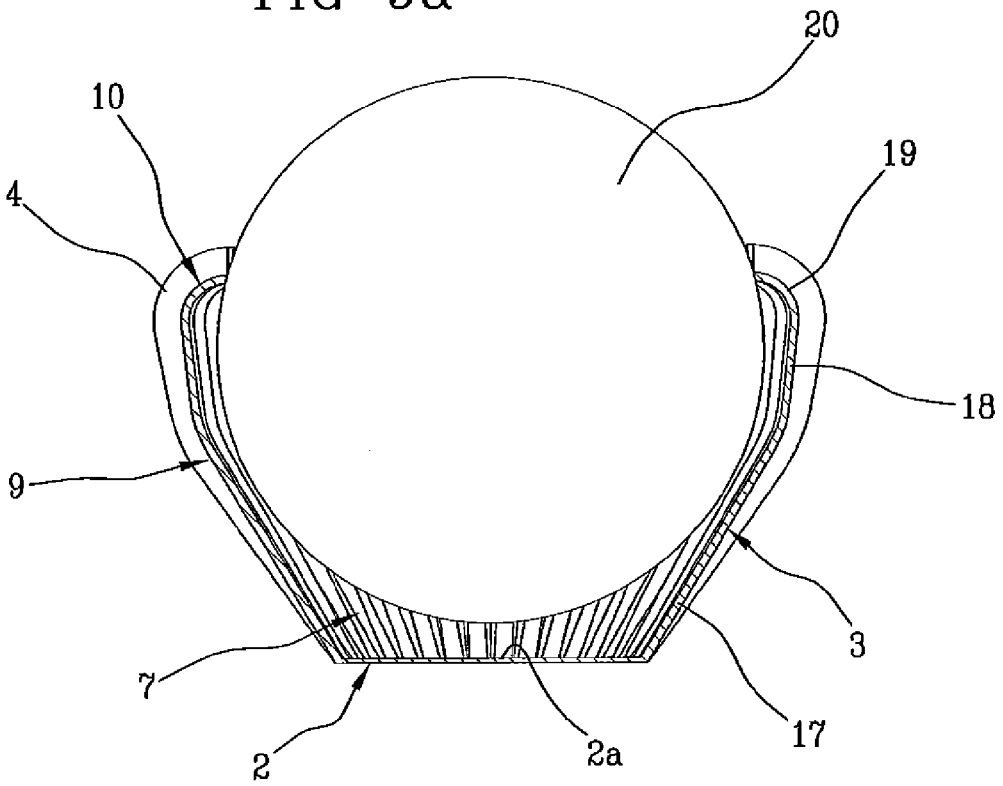
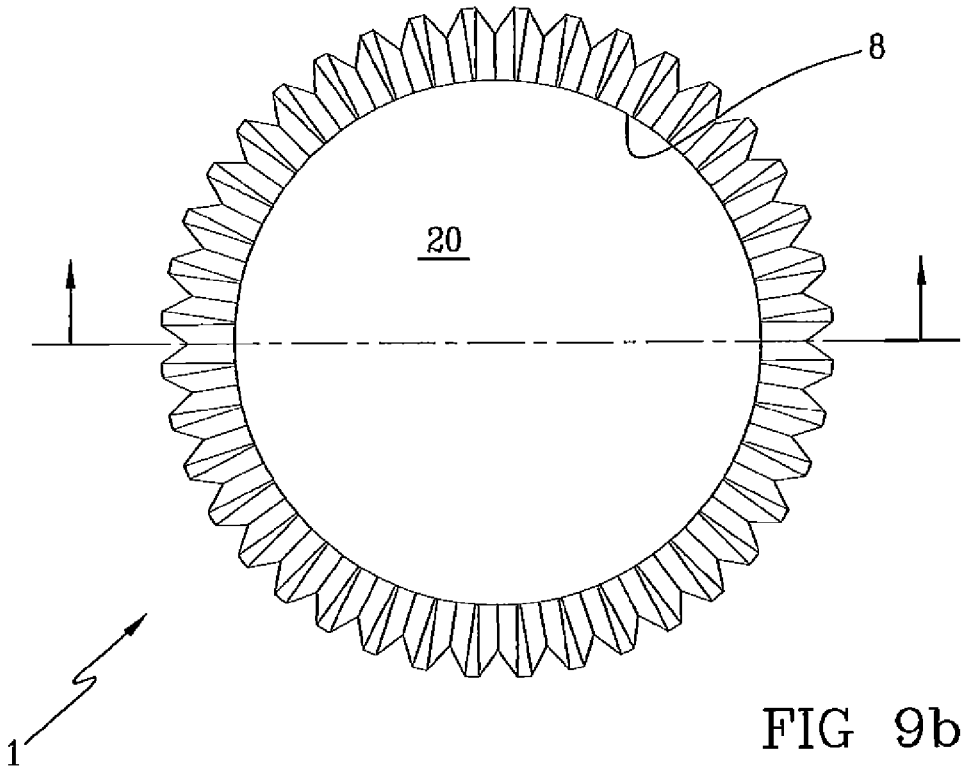
FIG 9b

FIG 10a
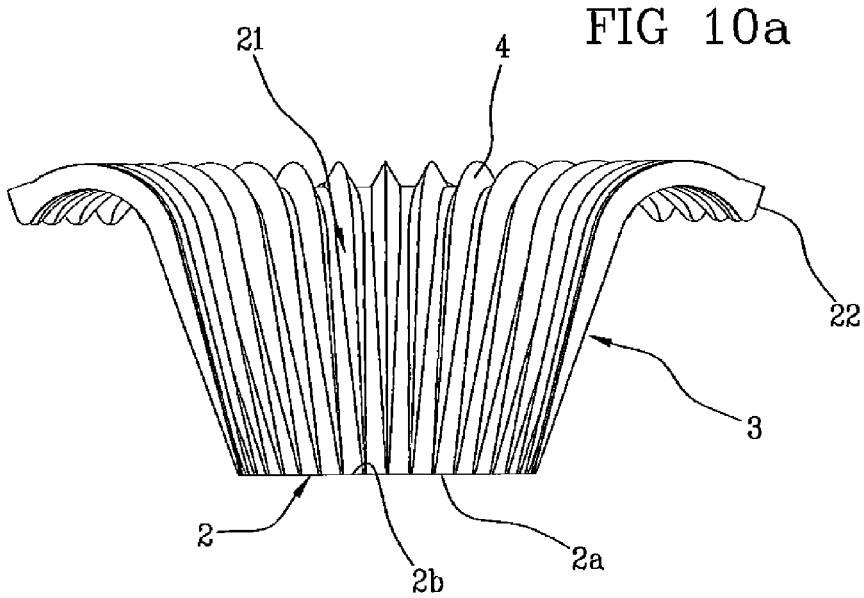
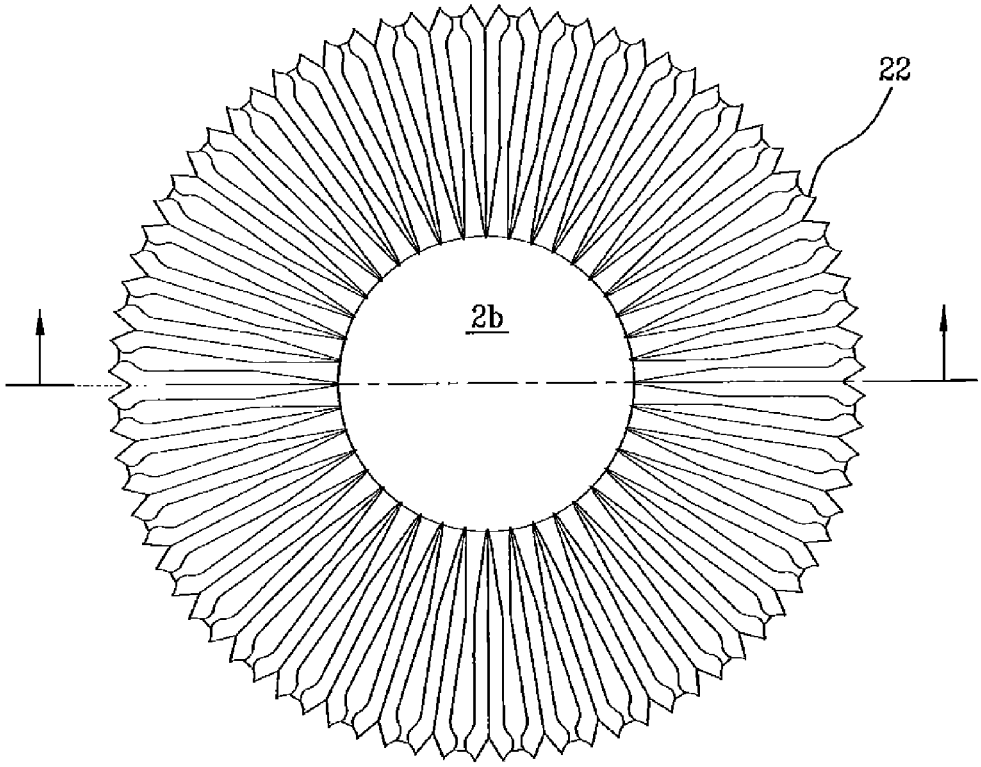
FIG 10b

FIG 11a
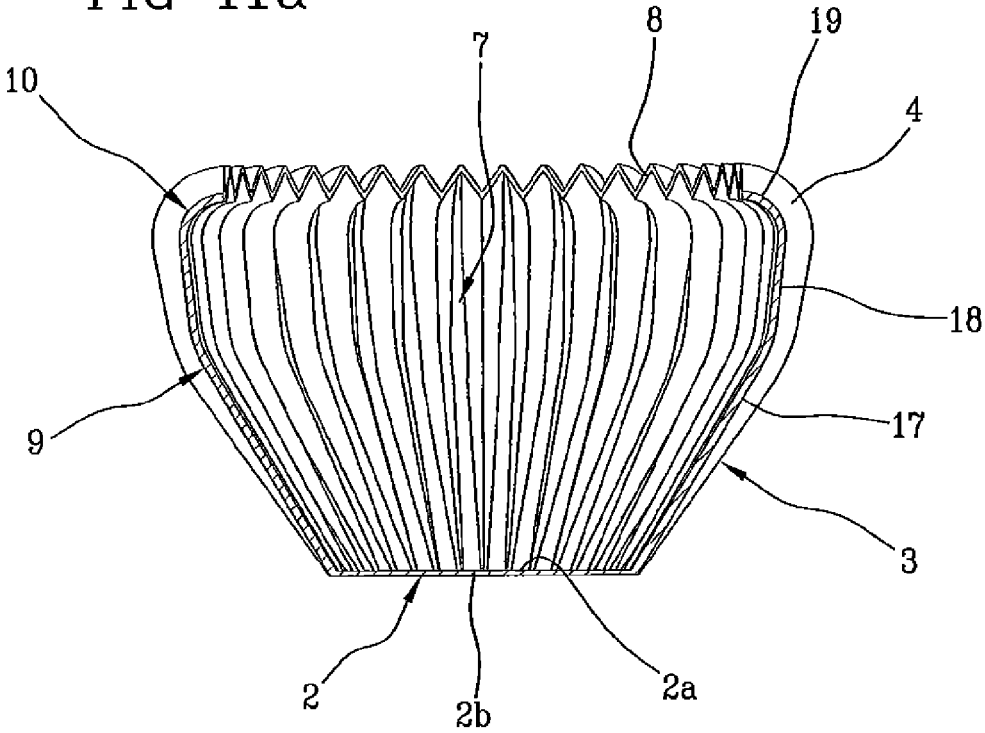
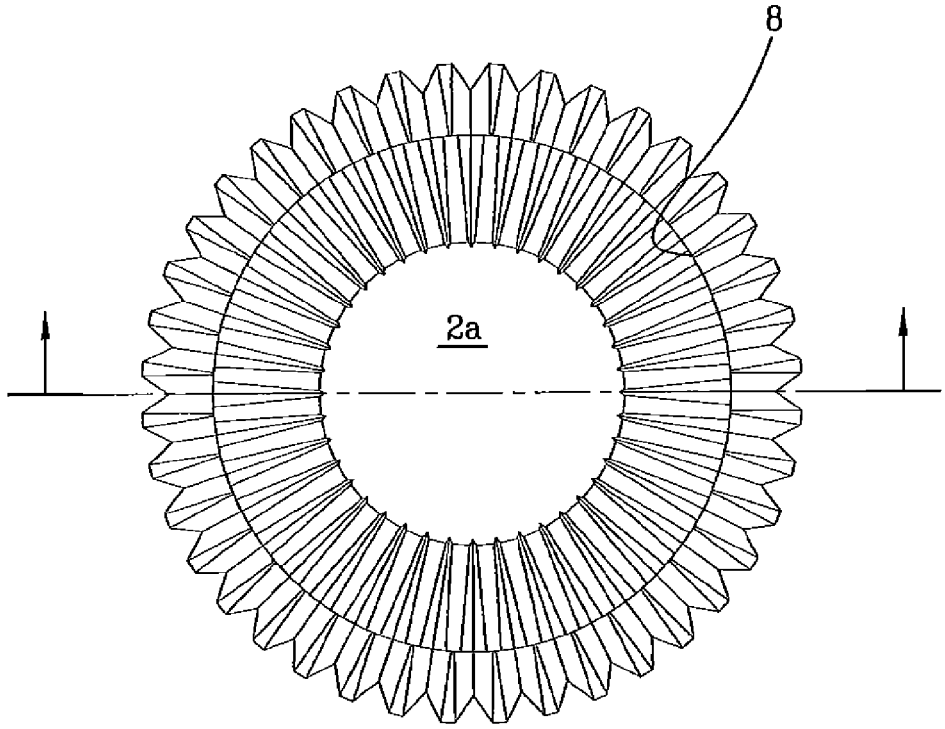
FIG 11b

METHOD FOR MANUFACTURING A CONTAINER OF PAPER MATERIAL, PARTICULARLY FOR FOODSTUFFS

The present invention relates to a method of manufacturing a container made of a sheet material, preferably paper, for foodstuffs, in particular for products such as pastries, small cakes and the like.

It is a further object of the invention to provide a production process and a packaging or wrapping-up process for a foodstuff.

It is known that containers of paper material for foodstuffs, in particular for confectionery goods of small sizes such as pastries and the like, known in the technical field as "bun cases", generally consist of a single portion of paper material, of circular shape for example, obtained by a punching or cutting-away operation and suitably shaped so as to obtain a flat bottom wall and a flared side wall in the form of a truncated cone so as to promote formation of packets and containers suitable to be stacked up on each other.

The bottom wall and side wall form a cavity having an opening facing upwardly in the normal use position of the container. In addition, the side wall is normally made up of a pleating formed with pleats and waves having a substantially vertical extension direction, i.e. a direction corresponding to the apothem of the truncated cone, and defining an indented upper edge.

Generally, the bun cases are obtained starting from a flat sheet of suitable sizes, made of paper material, which is drawn by means of male-female dies capable of forming the flat bottom wall, as well as the corresponding pleats on the side wall.

Following the drawing operation, a slight spring-back of the paper defining the side wall makes the container take its final frustoconical shape.

In particular, by examining a section in a plane orthogonal to the bottom wall, in these containers of known type it is possible to highlight a side wall defined by a rectilinear stretch that is connected to the bottom wall.

The above described containers that have reduced costs and are of relatively easy accomplishment, are actually very widespread in the commercial field and have been on the market for more than 90 years with a substantially unchanged shape.

However, although this type of bun cases is commercially successful, it is not clear of some drawbacks and/or operating limits.

First of all, it is to be pointed out that the particular frustoconical shape does not offer an important resistance to side deformations.

This is mainly due to the fact that the side wall, taking into account how it is made (i.e. starting from a flat sheet), has some material in excess that is used for creating the pleating. In other words, following pressures on the side walls directed from the inside of the container to the outside, the paper material constituting said container tends to open and come back to its original flat state.

It is also to be noted that at the moment the paper constituting the container becomes wet, due to the presence of a foodstuff inside it for example, the side wall itself further loses its resistance to deformations and bends reaching the flat conformation.

In particular, it may often happens that following conservation of the foodstuff in the refrigerator (a wet place), the side wall will come back to its flat conformation, even only partly, so that replacement of the container is required before sale.

In addition, since the container's shape has been substantially unchanged and standardised for many years, a modification of same would surely help in giving a particular new appearance to the container-cake assembly, making the whole different and aesthetically more appreciable as compared with containers of known type.

Besides the mentioned containers, it is also known from the European document No. EP 1253090 a container of paper material for pastries consisting of a holding structure having a bottom wall and a side wall with a rounded or convex shape, capable of encompassing a possible product contained inside it.

This document does not teach any manufacturing method for obtaining such a container.

The French patent No. FR 2767513 too discloses a container of paper material adapted to house foodstuffs in which a bottom wall and a side wall form an upwardly open cavity, under normal use conditions of the container.

The side wall is formed with successive pleats and has undulations disposed in a vertical orientation.

The containers in accordance with the French document are of frustoconical shape and obtained starting from a flat sheet of paper material of suitable sizes that is drawn by means of male/female dies capable of producing a flat bottom and corresponding pleats on the side wall.

Also known from document GB 128187 is a holding case of paper material manufactured starting from a flat sheet having a circular central region from which a plurality of petals or sectors emerge, which sectors following pleating overlap each other and define a final convex conformation encompassing a possible product contained therein.

While presently known are types of containers of paper material obtained from a single sheet which are different from the traditional frustoconical bun cases, no manufacturing method for obtaining these containers is however known which is of easy accomplishment and adapted to create said configurations in a simple, direct and reliable manner.

It is in fact to be noted that convex containers have side walls with such relative inclinations to a vertical directrix that it is substantially very difficult with the traditional technologies to be able to reach sufficient pressures to enable the final shape of the product to be maintained.

The present invention substantially aims at solving the mentioned drawbacks present in the known art.

A first aim of the invention is to make available a production process enabling bun cases having shapes different from the frustoconical ones to be obtained in a simple and efficient manner, being able to ensure, during manufacture, that sufficient pressures are generated for maintenance of the shape even in the presence of said shaped configurations.

Another aim of the invention is to enable manufacture of shapes different from the traditional ones.

Finally, it is a non negligible aim of the invention to make available a production process and a packaging or wrapping-up process for the foodstuff that can be integrated with each other.

The foregoing and further aims that will become more apparent in the progress of the following description are substantially achieved by a production process for a container of paper material designed to contain foodstuffs in accordance with the appended claims.

Further features and advantages will become more apparent from a detailed description of a preferred but not exclusive embodiment of a production process in accordance with the invention.

Figure 4:
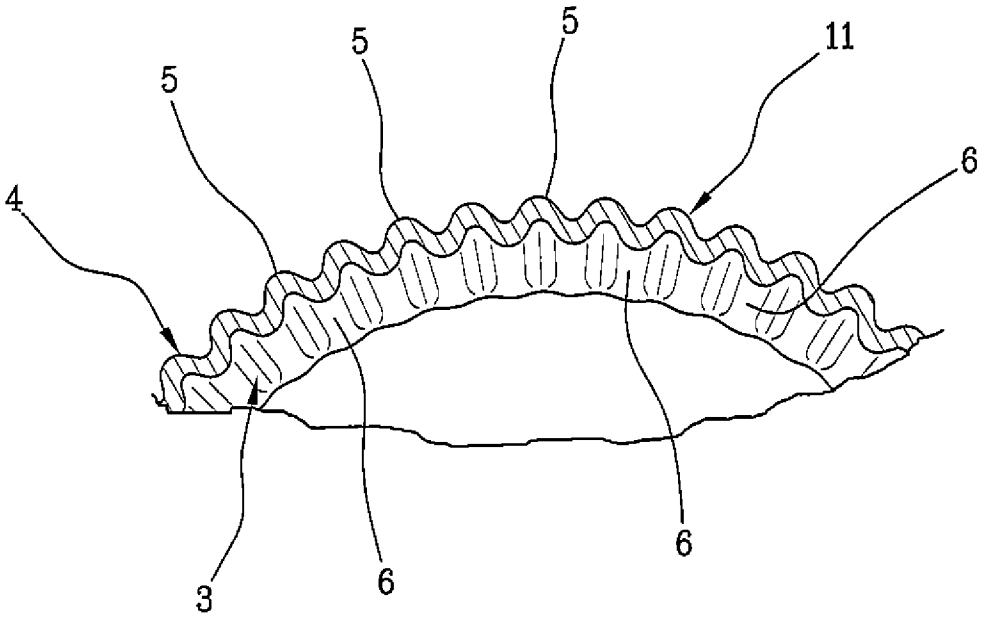
Figure 5:
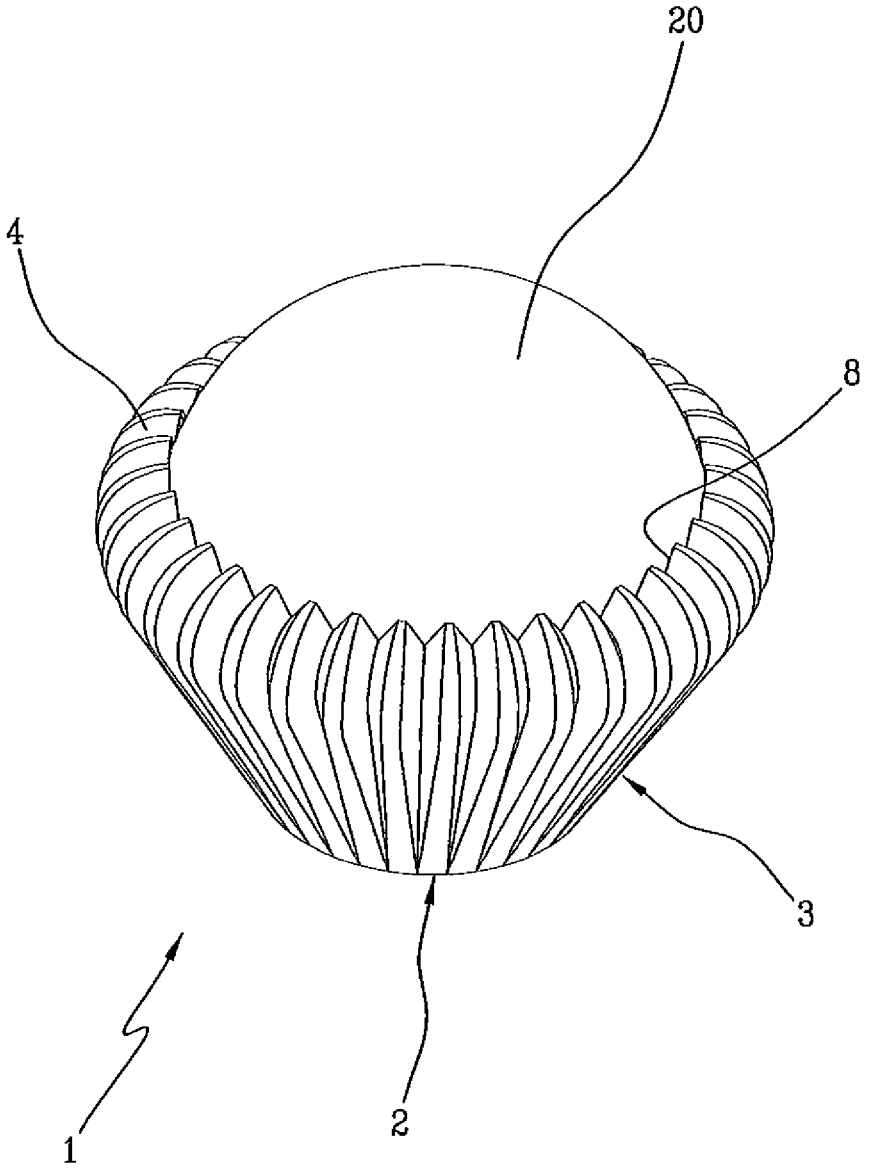
Figure 9:
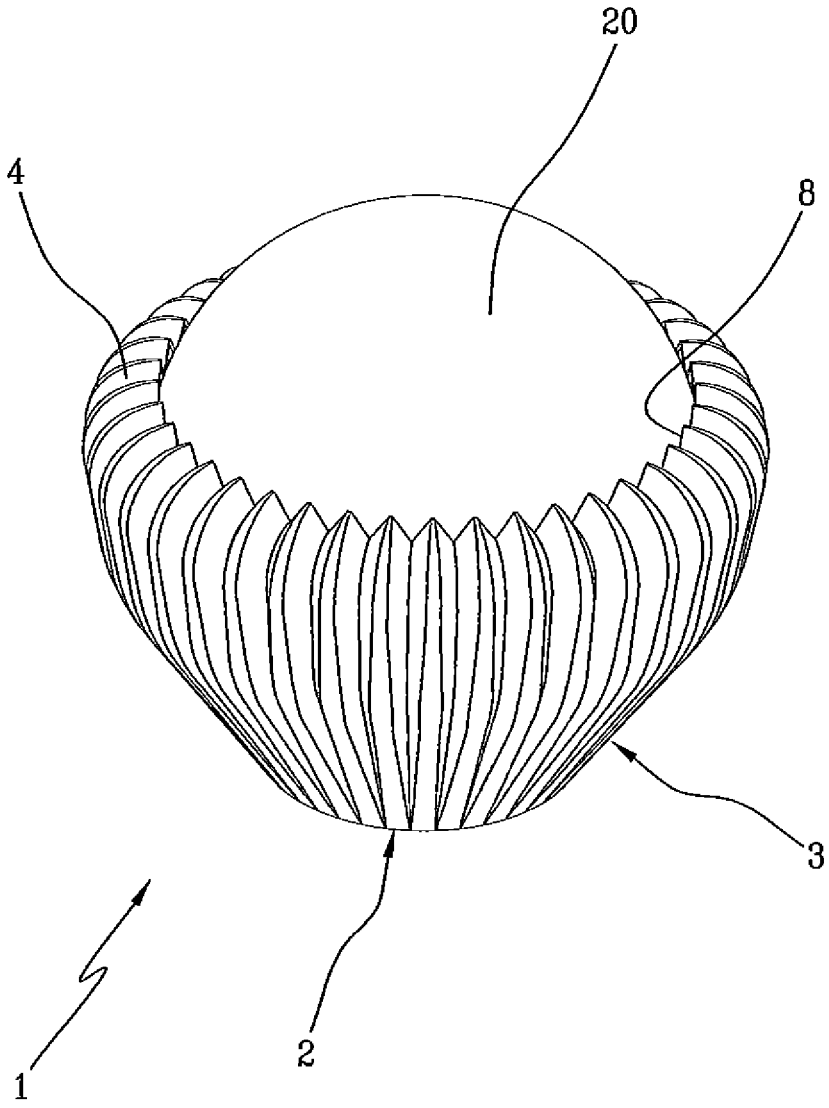
Figure 12C:
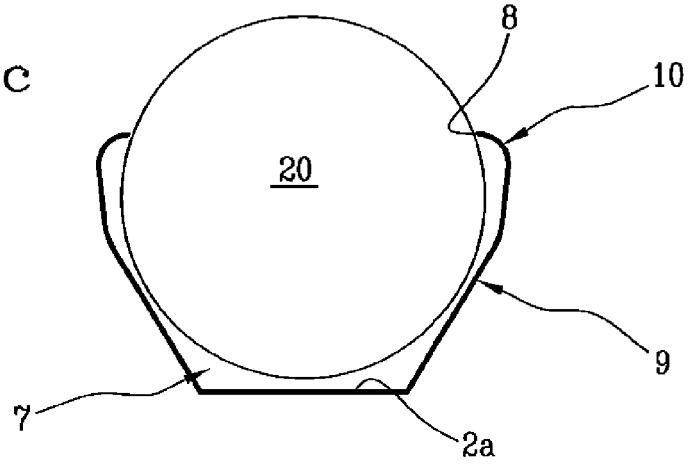
Figure 12B:
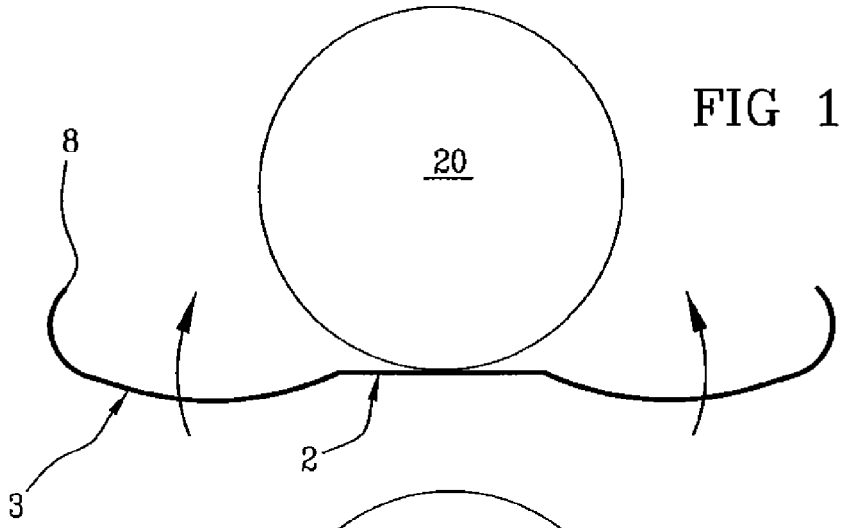
Figure 12A:
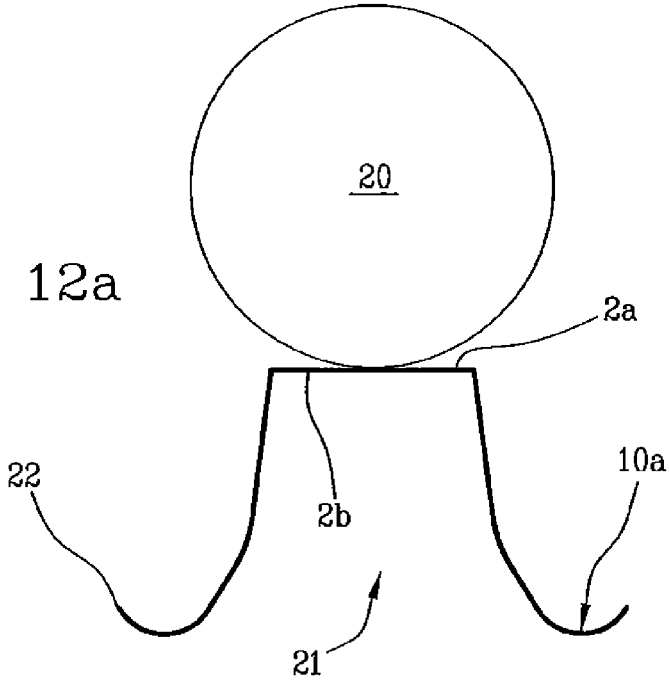

The description will be made hereinafter with reference to the accompanying drawings given by way of non-limiting example, in which:

FIGS. 1, 1*a*, 1*b*, 5, 5*a*, 5*b*, 9, 9*a* and 9*b* show three different embodiments of a container of paper material containing a foodstuff obtained by a method in accordance with the present invention, in a perspective view, in section and from above, respectively;

FIGS. 2, 2*a*, 2*b*, 6, 6*a*, 6*b*, 10, 10*a* and 10*b* show a container of paper material in a semifinished-production step, before the final manufacturing and packaging operations;

FIGS. 3, 3*a*, 3*b*, 7, 8*a*, 8*b*, and 11, 11*a*, 11*b* show the finished container of paper material, without the product that will be contained therein;

FIG. 4 shows a partial section of the container seen in FIGS. 1, 5 and 9, taken in a horizontal plane;

FIGS. 12*a*, 12*b* and 12*c* show, in a simplified section taken in a vertical plane, three successive production steps of the container seen in FIG. 9.

With reference to the drawings, the container of paper material according to the invention has been generally identified with reference numeral 1.

It is preferably made up of a single portion of sheet of flexible material, generally paper (although with greater costs and more complicated manufacturing processes, it would be possible to contemplate the possibility of making said container using more than one sheet: a sheet for the bottom wall and one secured to the first sheet, for the side wall, for example).

This portion of paper material cut out in the form of a circle, if the container is provided to be of circular shape for example, defines a flat bottom wall 2 from which a side wall 3 emerges.

Since in its preferred embodiment the container is made starting from a single flat sheet of paper material, the material designed to define the side wall 3 after the first folding appears to be in excess and therefore cannot give rise to a perfectly smooth wall.

Under this situation, there are substantially two alternative solutions.

In a first type of containers, not shown, flattening of the side wall is carried out by pressing said wall upon itself so that the latter takes a conformation that is as much as possible smooth to the touch.

It is apparent that, since an excess material is present, a predetermined number of irregular pleats are created on the side wall which have a major extension transverse to the bottom wall.

Looking at this type of containers, it is possible to see that in a section of the side wall along a plane substantially parallel to the bottom wall, the profile defined by the side wall is of a substantially circular type, as much as possible close to the profile that would be defined by a perfectly smooth surface. Due to the excess material however, in this closed profile there are some regions showing overlapping material.

The other type of container that is generally the preferred one (see FIGS. 1, 5, 9) is on the contrary provided with a series of substantially vertical pleats arranged on the container in a regular manner.

This type is represented in the accompanying figures where the side wall shows a pleating consisting of pleats or undulations 4 having an extension substantially in a direction transverse to the bottom wall 2.

In detail as to structure, the pleats give a three-dimensional appearance to the side wall, that in a section of the container taken along a plane parallel to the bottom wall, is provided with a closed circular profile 11 with an undulated course similar to a sinusoid (see FIG. 4).

The maxima of this sinusoid define a raised region 5 on the extension surface of the side wall, while the minima constitute hollow regions 6.

Given the alternate and regular succession of maxima and minima in the section, the raised regions 5 and hollow regions 6 will extend in mutual side by side relationship along the whole extension of the side wall.

It should be noted that the presence of a side wall having a three-dimensional extension due to the presence of undulations greatly increases the resistance of the container to stresses tending to deform the container itself crushing it.

The bottom wall 2 and side wall 3 form a cavity 7 adapted to house a foodstuff and having an upwardly facing opening in the position of normal use of the container.

This opening defining the cavity 7 of the container is delimited by the bottom wall 2 and the side wall 3 terminating at the top with an edge 8 defining the opening contour.

In the preferred embodiment of the present invention no curl-shaped reinforcing band is provided in the continuation of the side wall 3 for defining an overturned edge. In other words, the side wall 3 starts from the bottom wall 2 and terminates at the edge 8 so as to define the opening contour.

In fact, as viewed from FIGS. 1, 5 and 9, the upper edge of the side wall is free and exhibits a substantially sinusoidal conformation.

By a detailed analysis of the shape of the container being the object of the present invention, in particular with reference to FIGS. 3*a*, 8*a* and 11*a* showing the container in side section, it is possible to see that in section along a plane substantially perpendicular to the bottom wall 2, the side wall is defined by a stretch 9 joining the bottom wall 2 to the contour of opening 8.

Advantageously, this stretch 9 has at least one curved portion 10.

Preferably, the shape of the curved portion 10 is suitable to give the side wall a substantially concave course, the concavity being turned towards the cavity 7 of the container, under use conditions of the latter.

Generally, as a result of the fact that the container is made starting from a single paper sheet, the curved portion can also substantially extend along the whole length of the stretch defined in section by the side wall.

For instance, the line of the side wall in section in a vertical plane can be defined by an arc of a circumference (which situation is not shown); alternatively it can instead have a more complicated course (shown in FIGS. 1 and 3) consisting of a first stretch 12 coming out of the bottom wall and being substantially rectilinear, then a second stretch 13 with a curvature towards the inside of cavity 7 (the curved portion 10), and finally a turned-up end portion 14, which is substantially curved as well, turned up towards the outside and delimited by edge 8.

Figure 7:
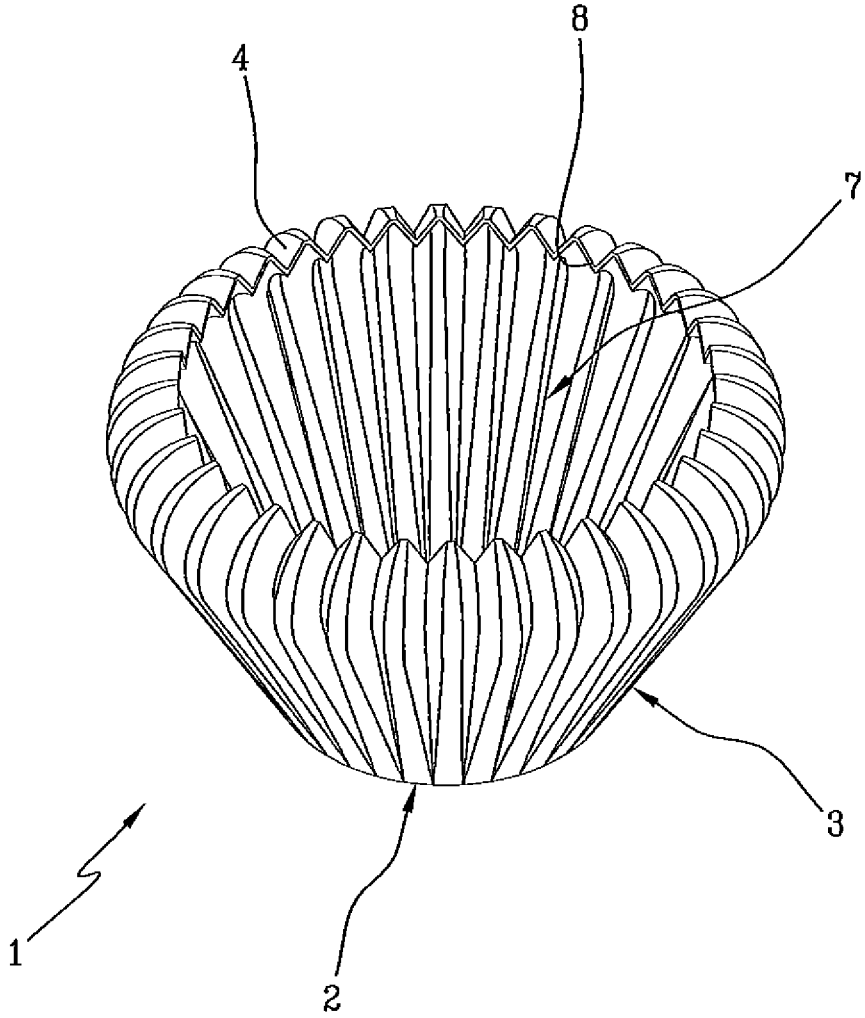

As a further possibility, FIGS. 5 and 7 show a container in which the stretch 9 defining the side wall 3 in section has a first rectilinear portion 15 directly emerging from the bottom wall 2 and extending over at least two-thirds of the container height; the first portion is connected to an end portion 16 (defining said curved portion 10) encompassing the product or foodstuff 20 contained in the container in such a manner that the edge 8 substantially comes into contact with the product elastically retaining it inside the container.

In this connection it should be understood that generally (see all the embodiments) the containers 1 in accordance with the present invention can be made in such a manner that the curved portion 10 will define a rounded or convex region towards the inside of cavity 7, so that the free edge 8 defines a contour of the cavity opening 7 of smaller radial sizes than the maximum bulkiness of the product 20 contained therein.

In this manner, container 1 can elastically retain the product inside it avoiding use of viscous or sticky substances for retaining said product 20 in contact with the bottom wall 2.

Figure 11:
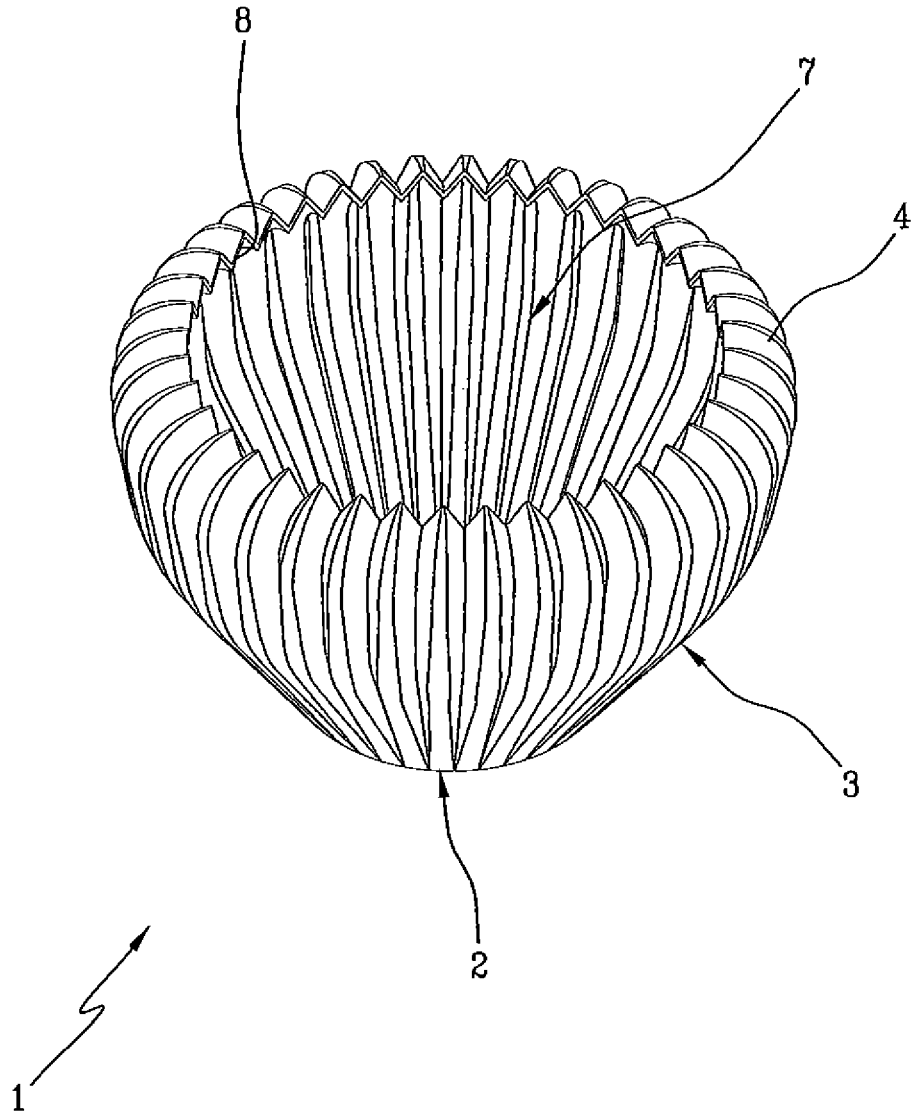

In a third embodiment shown in FIGS. 9 and 11, the container has a first rectilinear portion 17 emerging away from the bottom wall 2 with an inclined course relative to the vertical axis of the container.

Connected to the first portion is a second stretch 18 which is rectilinear too and has a substantially vertical orientation under normal use conditions of the container (the first portion 17 and the second stretch 18 therefore defining a broken line in section).

A curved end portion 19 is connected to the second stretch 18 and it is turned over towards the inside of cavity 7 in such a manner that, once again, the free edge 8 clings the foodstuff 20 contained therein.

It is apparent that a multiplicity of embodiments of the container 1 can be provided by combining said straight and curved stretches of the side wall.

By way of example only, it is herein mentioned the possibility of also making a container in accordance with the European patent No. EP 1253090 in the name of the same Applicant.

At all events, in all the situations shown the container is characterised in that the side wall has a conformation with substantially convex regions adapted to encompass the product 20.

The containers of the invention have been mainly designed for containing cakes of small sizes (as previously said, they are substantially "bun cases"), so that the bottom wall will generally be of circular shape, as shown in the accompanying drawings, and will have a diameter preferably included between 10 and 110 mm, whose preferred range will be 20 to 90 mm.

It is a particular aim of the present invention to provide a production method (and/or a packaging or wrapping-up method for the foodstuff, as better shown in the following) of the previously described container of paper material.

First of all, manufacture of said bottom wall 2 (generally of round shape) is carried out, said wall having an upper surface 2*a* and a lower surface 2*b* opposite to each other (the two opposing round faces of the bottom).

Also made is said side wall 3 emerging from the bottom wall 2 in such a manner that with the latter it defines a holding region 21 the bottom surface of which is defined by said lower surface 2*b*.

While theoretically it is possible to make a bottom wall 2 and a separate side wall that are afterwards joined together, the preferred and illustrated embodiment shows said bottom and side walls 2, 3 made simultaneously in a single step from the same sheet of paper material, so that they are joined without a break (made of one piece construction by drawing).

Generally, the step of making the side wall gives the latter such a conformation that it exhibits the aforesaid predetermined number of pleats 4 having a major orientation transverse to the bottom wall, as shown in the drawings. Still during the step of forming the side wall 3, provision is made for making said stretch 9 joining the bottom wall 2 to a contour 22 of the holding region 21 in such a manner that the stretch 9 has at least one curved portion 10*a* before carrying out the following working steps.

In particular, the curved portion 10*a* of the side wall 3 in this step appears to be substantially convex, the convexity facing the holding region 21 of the semifinished product.

From the operating point of view, a flat element of paper material is submitted to a drawing operation so as to define said circular bottom 2 and pleated side wall 3 that, seen in section, has a curvature "opposite" to the desired one in the final container.

Under this situation the contour 22 (that will subsequently define edge 8) is presently turned towards the outside of the holding region 21.

Note also that the lower surface 2*b* of the bottom wall in the semifinished product will define a surface internal to the holding region 21, while the upper surface 2*a* will be turned externally, relative to said holding region.

Figure 2:
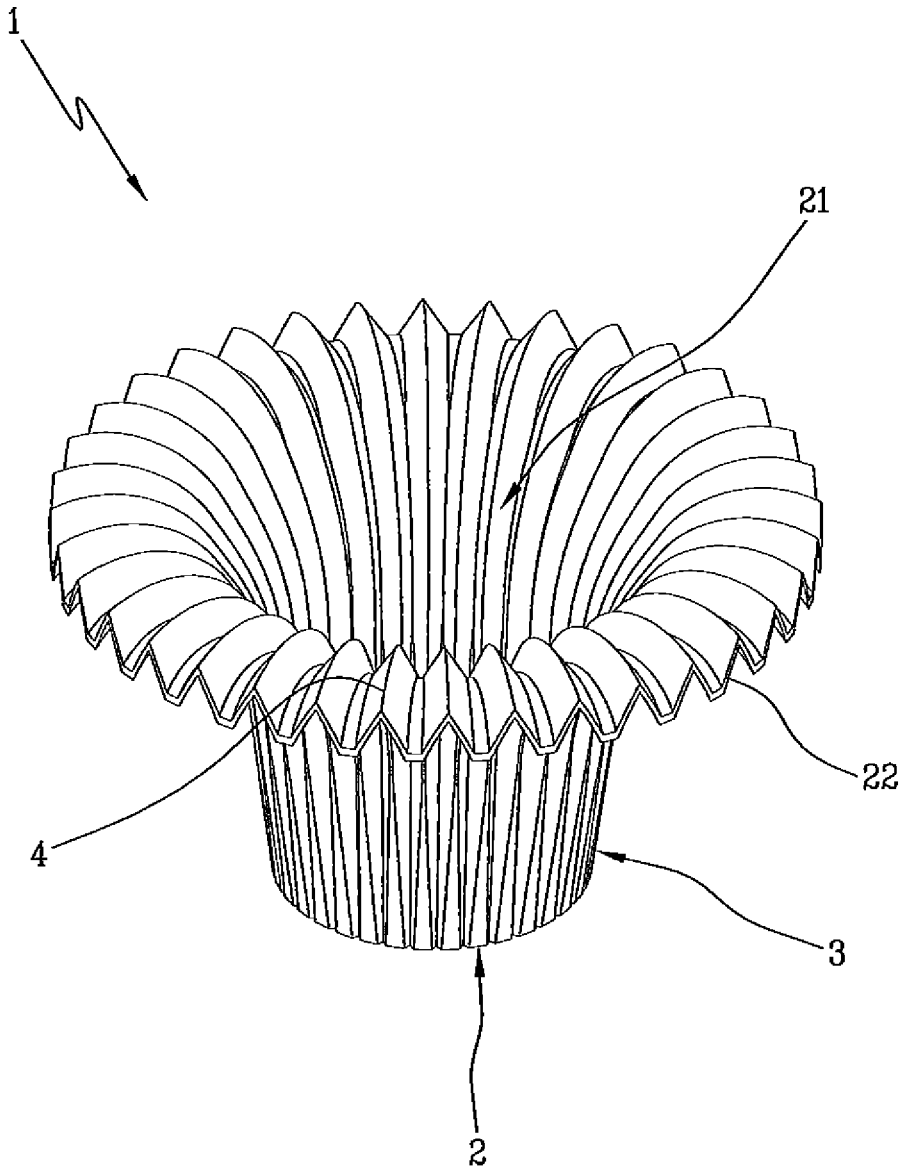
Figure 6:
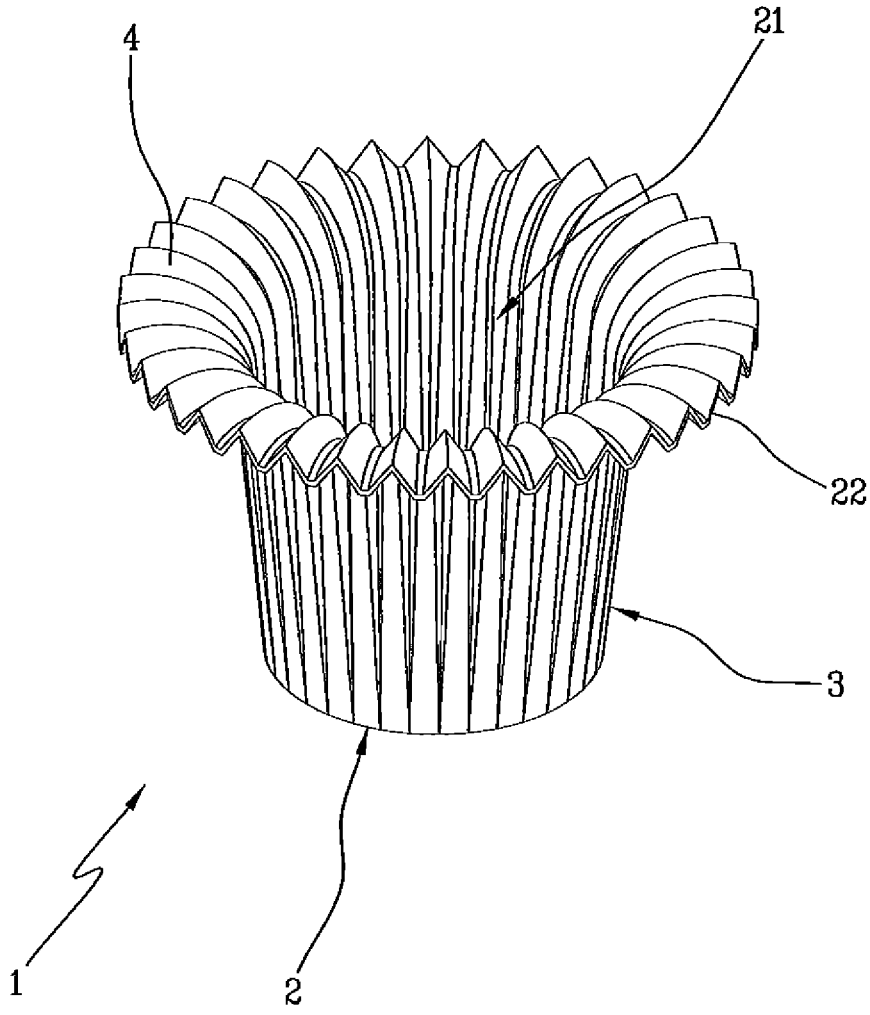
Figure 10:
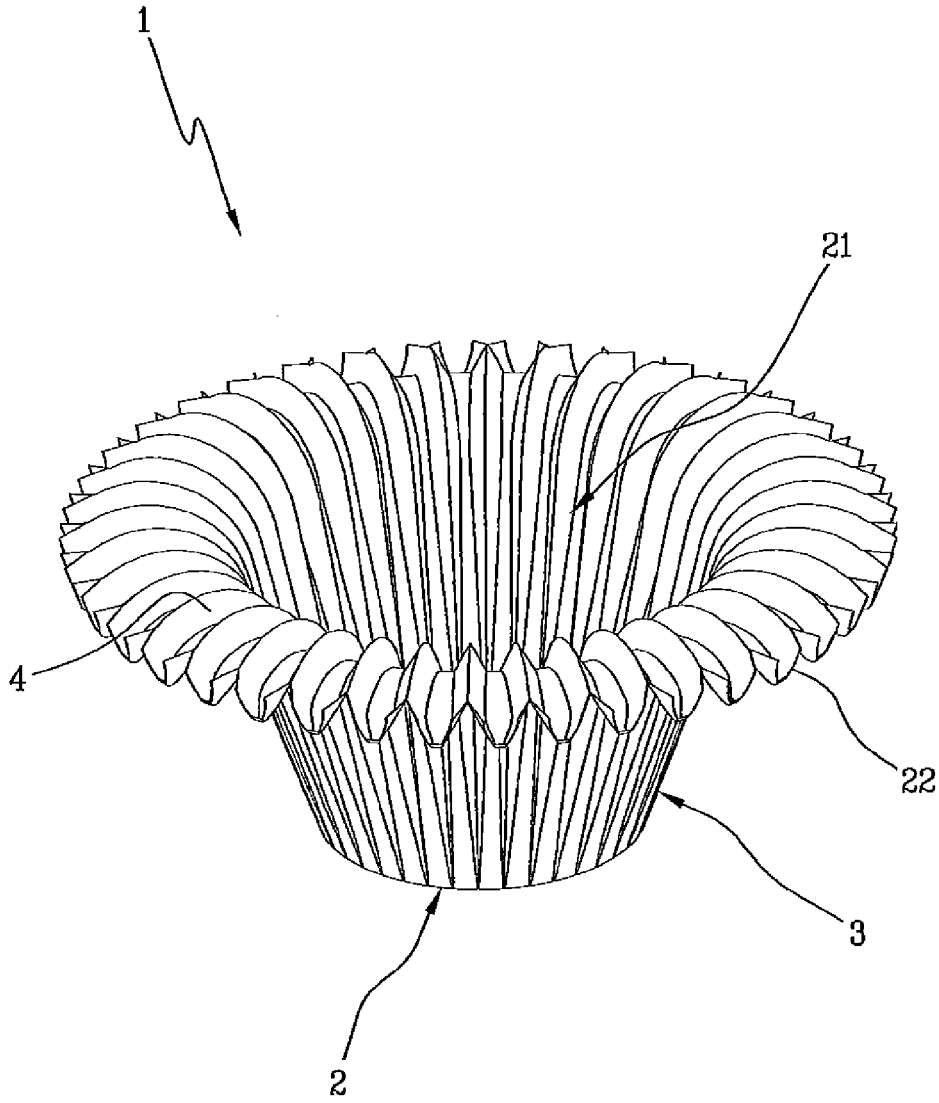

The production process for manufacturing said side and bottom walls therefore involves a drawing step for making the semifinished containers shown in FIGS. 2, 6 and 10, capable of giving assurance that during the pressing step sufficient pressures are generated that are adapted to give the semifinished product itself a sufficient stiffness degree enabling it to maintain its shape.

Figure 3:
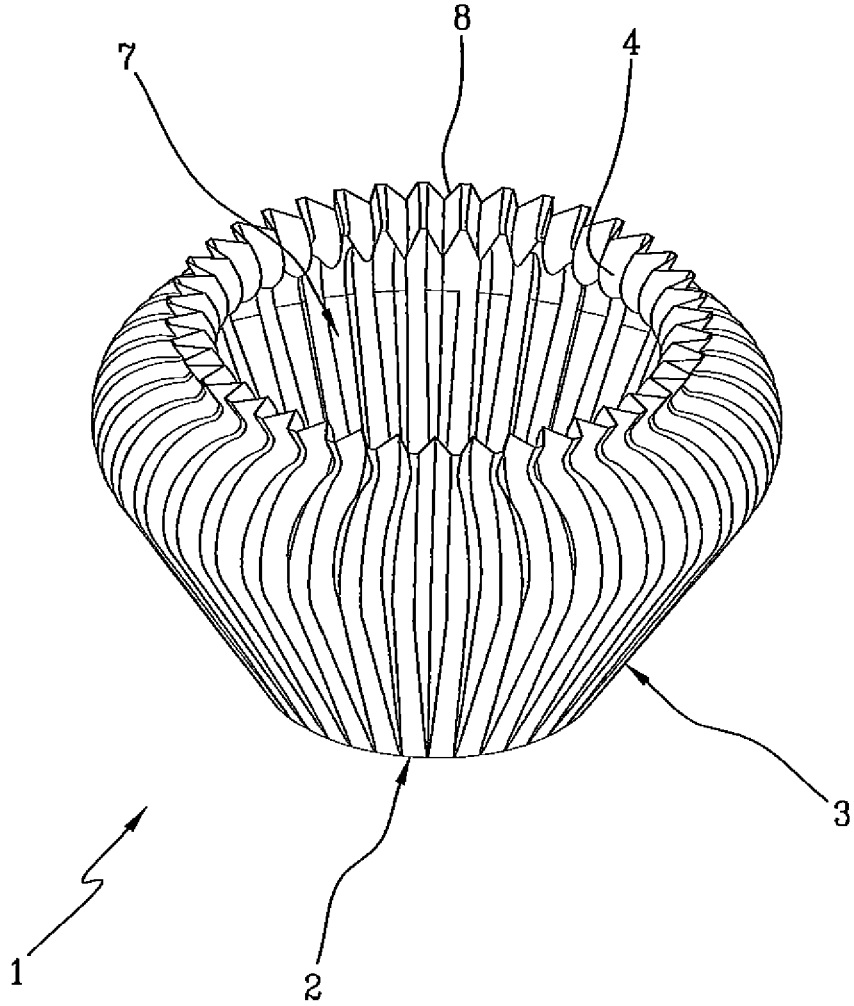

For passage from the container shown in FIG. 2 to that shown in FIG. 3 (or in an equivalent manner from the container in FIG. 6 to that in FIG. 7, or from the container in FIG. 10 to that in FIG. 11), the side wall 3 is turned over on the opposite side relative to the bottom wall 2 so as to define the aforesaid cavity 7 having its opening facing upwards in the position of normal use of the container.

Under this situation, the cavity 7 has its bottom defined by the upper surface 2*a* while the lower surface 2*b* (previously contained in the holding region 21) will be external to the container itself.

The overturning steps are shown in FIGS. 12*a*-12*b*.

As can be viewed, the side wall 3 is such deformed that it moves around the perimeter of bottom 2 reaching the opposite side relative to said bottom, in the final configuration of the container.

By carrying out this passage, the rectilinear section stretches remain such, while the portions 10*a* that in the semifinished product had a convexity facing the holding region 21, become now curved portions whose concavity faces the cavity 7 for housing the foodstuff, thus defining said rounded or convex structure.

It is to be pointed out that optionally, and in a manner still more advantageous, before the overturning step a product 20 that has to be contained in cavity 7 can be positioned close to the upper surface 2*a* of the bottom (i.e. externally of the holding region 21).

Following the overturning step, the product 20 will be contained in cavity 7, being encompassed by the side wall 3.

The invention achieves important advantages.

First of all, for the first time after many years a container of a particular shape has been made available which is able to give a different aesthetic impact to the confectionery product that is on display.

From a more technical point of view, due to the particular conformation of the side wall, the container has an optimal behaviour towards the lateral deformations.

In particular, following a pressure directed from the inside to the outside of the container on the side wall, this side wall tends to close on the product, instead of opening.

In case of a wet environment too, the side wall has such a conformation that the paper fibre has a tendency to close on the product instead of opening and falling downwards.

On the other hand, it should be recognised that the capability of stacking up the products for storage and transport is maintained substantially unchanged without involving disadvantages relative to the known art also as regards this feature.

The described production method appears to be of very simple accomplishment enabling manufacture of containers seemingly having very complicated shapes by means of secure and well-tested procedure steps (drawing).

In other words, the method of the invention allows containers of paper material to be made which are provided with undercuts facing the inside of the cavity, which undercuts cannot be obtained in an alternative manner, except by use of complicated moving dies and very high pressures during the pressing step.

In addition, due to the possibility of wrapping up or "packaging" the product during the overturning step, it is possible to produce semifinished containers while the final container will be made in the place where the foodstuff is produced, the costs for storage and transport remaining unchanged and the packaging costs being greatly reduced as packaging can be directly done in the factory where the foodstuff is produced with a single and simple operation.

The invention claimed is:

1. A method of manufacturing a container of paper material, in particular for foodstuffs, the container comprising a sheet portion of flexible material defining a substantially flat bottom wall (2) and a side wall (3) emerging from said bottom wall (2), said bottom wall (2) and side wall (3) forming a cavity (7) with an upwardly facing opening in the normal use position of the container, the side wall (3) in the use condition of the container being confined at the lower part thereof by the bottom wall (2) and at the upper part by an edge (8) defining a contour of the cavity opening (7), the side wall (3) in section along a plane substantially perpendicular to the bottom wall (2) being defined by a stretch (9) joining said bottom wall to the opening contour, the method comprising the steps of:

making said bottom wall (2) provided with an upper surface (2*a*) and a lower surface (2*b*) opposite to each other;

making said side wall (3) emerging from the bottom wall (2) and defining, in cooperation with the bottom wall (2), a holding region (21) whose bottom is defined by said lower surface (2*b*), characterised in that it further comprises the following step:

overturning the side wall (3) on the opposite side relative to the bottom wall (2) for defining a cavity having an upwards facing opening (7) in the normal use position of the container, said cavity having a bottom defined by said upper surface (2*a*);

characterised in that said step of making said side wall (3) comprises a sub-step of making said stretch (9) joining said bottom wall (2) to a contour (22) of the holding region (21) in such a manner that the stretch (9) has at least one curved portion (10*a*) before the overturning step.

2. A method as claimed in claim 1, characterised in that the steps of making said bottom wall (2) and side wall (3) are carried out in a single simultaneous step.

3. A method as claimed in claim 1, characterised in that the step of making said side wall (3) comprises a sub-step of forming a predetermined number of pleats (4) having a major extension substantially transverse to the bottom wall, the pleats, in a section of the side wall along a plane substantially parallel to said bottom wall (2), defining a closed profile (11) of undulated and sinusoidal extension.

4. A method as claimed in claim 1, characterised in that said step of making said stretch (9) comprises a step of making a substantially convex curved portion (10*a*) of the side wall (3) before the overturning step, the convexity facing the holding region (21) of the container.

5. A method as claimed in claim 1, characterised in that said step of making the bottom wall (2) is a step of making a bottom wall (2) having a substantially circular conformation of a diameter included between 10 and 110 mm.

6. A method as claimed in claim 1, characterised in that said container is made of a paper material and defined by a curved and folded single portion of a sheet.

7. A method as claimed in claim 1, characterised in that after the overturning step the side wall (3) is of a rounded or convex conformation.

8. A method as claimed in claim 1, characterised in that before the overturning step a further step is present which consists in positioning a product to be contained in the cavity (7) at the level of the upper surface (2*a*) of the bottom, following the overturning step the product being contained in the cavity (7) and encompassed by the side wall (3).

* * * * *